US006155503A

United States Patent [19]

Benson et al.

[11] Patent Number: 6,155,503

[45] Date of Patent: Dec. 5, 2000

[54] SOLENOID ACTUATOR ASSEMBLY

[75] Inventors: Donald J. Benson; Laszlo D. Tikk, both of Columbus, Ind.

[73] Assignee: Cummins Engine Company, Inc., Columbus, Ind.

[21] Appl. No.: 09/084,018

[22] Filed: May 26, 1998

[51] Int. Cl.[7] ..... B05B 1/30

[52] U.S. Cl. ..... 239/585.1; 335/278; 335/281

[58] Field of Search ..... 239/585.11, 585.2, 239/585.3, 585.4, 585.5; 335/278, 281

[56] References Cited

U.S. PATENT DOCUMENTS

| | | | |
|---|---|---|---|
| 2,881,980 | 4/1959 | Beck et al | 239/585.1 |
| 4,678,160 | 7/1987 | Yamada et al. | 239/585.1 |
| 4,924,126 | 5/1990 | Isozumi | 335/278 |
| 4,962,871 | 10/1990 | Reeves | 335/281 |
| 4,993,636 | 2/1991 | Taue et al. | 239/585.1 |
| 5,035,360 | 7/1991 | Green et al. | 239/585.1 |
| 5,441,028 | 8/1995 | Felhofer | 239/585.1 |
| 5,488,340 | 1/1996 | Maley et al. | 335/281 |
| 5,566,921 | 10/1996 | Yukota et al. | 329/585.3 |
| 5,608,368 | 3/1997 | Ricco et al. | 335/281 |
| 5,608,369 | 3/1997 | Irgens et al. | 335/281 |
| 5,676,114 | 10/1997 | Tarr et al. | 239/585.1 |
| 5,903,070 | 5/1999 | Gobel | 335/278 |
| 5,939,963 | 8/1999 | Harcombe | 335/220 |

FOREIGN PATENT DOCUMENTS

| | | | |
|---|---|---|---|
| 0795881 | 9/1997 | European Pat. Off. . | |
| 0845791 | 6/1998 | European Pat. Off. . | |
| 1045546 | 12/1958 | Germany . | |
| 1077784 | 3/1960 | Germany . | |
| 3527174 | 2/1987 | Germany | 239/585.4 |
| 0025072 | 2/1984 | Japan | 239/585.2 |
| 3-142804 | 6/1991 | Japan . | |
| 1035648 | 8/1983 | Russian Federation . | |
| 0396972 | 8/1933 | United Kingdom . | |
| 2215397 | 9/1989 | United Kingdom | 239/585.5 |

OTHER PUBLICATIONS

Skinner General Catalog V–60 Skinner Electric Valve Division (New Britain, Connecticut. (Pp. 2.3, 2.4, 3.1–3.8, 4.1–4.5), Jan. 1978.

United Kingdom Search Report dated Oct. 18, 1999.

*Primary Examiner*—Lesley D. Morris
*Assistant Examiner*—Jorge Bocanegra
*Attorney, Agent, or Firm*—Nixon Peabody LLP; Charles M. Leedom, Jr.; Tim L. Brackett, Jr.

[57] ABSTRACT

The improved solenoid actuator assembly of the present invention includes a solenoid stator assembly positioned in an actuator housing and a flux dissipation reducing feature which minimizes flux leakage into the housing thereby maximizing the attractive force and minimizing the response time. The flux dissipation reducing feature includes a slot formed in the housing adjacent each outer face of the solenoid stator pole pieces thereby avoiding a metallic housing wall into which leakage may occur. The slots also permit the cross sectional area of the pole pieces to be maximized thereby increasing the available attractive force. The solenoid stator assembly requires only a single housing which functions to directly support the laminate stack assembly without an intermediate housing while also functioning as an injector body component subject to the compressive assembly load of the injector and including high pressure fuel passages. As a result, the present solenoid actuator assembly is compact, inexpensive and functions to optimally maximize attractive forces while reducing response time.

27 Claims, 4 Drawing Sheets

SOLENOID ACTUATOR ASSEMBLY

TECHNICAL FIELD

The present invention generally relates to a compact solenoid actuator assembly for operating a control valve in a fuel system and, specifically, a solenoid actuator assembly including a stator assembly positioned in a housing which maximizes the size of stator pole faces while minimizing flux leakage thereby ensuring a strong attractive force.

BACKGROUND

Fuel injection into the cylinders of an internal combustion engine is commonly controlled using a solenoid operated fuel injection control valve. Typically, a solenoid actuator is energized to move a control valve element in a first direction causing the beginning of an injection event and de-energized to allow the control valve element to move in an opposite direction causing an end to the injection event. Minimizing the packaging size of a solenoid operated fuel injection control valve continues to be an important objective in designing components capable of fitting within the packaging constraints of a variety of engines. Such packaging constraints are of particular concern when the solenoid operated control valve is mounted on a fuel injector body. An even greater challenge exists in designing a solenoid operated control valve which can be incorporated within the injector body close to an injector nozzle assembly while maintaining, or minimizing, the size of the injector and achieving the control valve response time necessary for effective control of injection metering and timing. More importantly, designing an actuator housing for the solenoid actuator to decrease flux dissipation into the housing for maximizing a stronger attractive force is still a problem that has not been alleviated.

Recent and upcoming legislation resulting from a concern to improve fuel economy and reduce emissions continues to place strict emissions standards on engine manufacturers. In order for new engines to meet these standards, it is necessary to produce fuel injection systems capable of achieving higher injection pressures, controlled injection rates and fast response while maintaining accurate and reliable control of fuel metering and injection timing functions. As a result, solenoid actuator assemblies are undergoing structural modifications which assist in achieving these objectives. However, these improvements often undesirably increase the size of the injector which must conform to overall size restrictions or packaging constraints dictated by the mounting arrangement on a particular engine.

A solenoid actuator includes a core which forms pole pieces for attracting an armature connected to the control valve element. The core may be formed of a laminated stack of plates, i.e. laminate stack assembly, which is often chosen because of increased core resistivity. A laminate stack assembly permits faster magnetization and demagnetization of the solenoid by breaking up eddy current paths thereby reducing eddy currents. Conventional E-type or shaped laminate stack assemblies include three legs positioned in an inner cavity of an actuator housing. The end, or traction, faces of the legs are positioned adjacent the armature. The cross sectional areas of the end faces play a major role in determining the traction, or attractive, force on the armature. Increasing the attractive force results in a desirable decrease in the response time of the actuator/control valve thereby providing greater control of fuel injection timing and metering.

Attempts have been made to provide the response time required in high speed, high pressure applications. For example, the attractive force of the stator assembly of the solenoid actuator assembly can be increased by increasing the surface area of the stator pole end faces thereby decreasing response time. The end face area is increased by sizing and shaping the stator assembly to occupy a maximum amount of the space in a surrounding housing. However, it has been determined that flux leakage into the housing is created due to the substantially small spacing formed between the stator assembly and the interior surface of the housing thereby adversely affecting the operation of the assembly.

U.S. Pat. No. 5,676,114 issued to Tarr et al. discloses a fuel injector including a hydraulically controlled nozzle valve assembly. A solenoid actuator is mounted in the injector body adjacent the nozzle assembly for controlling the flow of fuel from a control volume to thereby control movement of the nozzle valve element. The solenoid actuator includes an E-type laminate stack assembly positioned in a generally circular or oval shaped cavity formed in an actuator housing. The legs of the E-type laminate stack assembly are conventionally shaped with a rectangular cross section. However, it has been determined that the conventional E-shaped laminate stack assembly, having legs with a rectangular-shaped cross section, does not create the response time necessary in certain applications.

U.S. Pat. No. 4,962,871 issued to Reeves discloses a solenoid actuated valve which maximizes the electromagnetic field generated by a solenoid coil so as to minimize the response time of the valve moving from a closed position to an open position. The actuator includes a dynamic pole having a generally circular shaped outer surface conforming to the inner surface of an assembly body. Grooves are formed in the outer surface to provide a path for fluid flow. Also, a static pole is positioned adjacent the dynamic pole. A valve plunger extends through the dynamic pole and into a bore formed in, and extending completely through, the static pole. However, the dynamic pole is connected to, and movable with, a valve plunger. As a result, the size of the dynamic pole is minimized to increase response time. Importantly, both the static and dynamic poles are formed of solid magnetic material. Thus, Reeves does not relate to laminate core assemblies nor E-type core assemblies. Also, the reference is not directed to a compact housing for the actuator which is capable of eliminating flux leakage into the housing.

German Patent No. 1,045,546 issued to Ulrich and Russian Patent No. 1,035,648 issued to Mindeli et al. disclose E-shaped laminate stack assemblies having legs with rectangular-shaped cross sections. The end faces of various legs include recesses formed from laminate plates having a shorter length than the remaining plates. Neither of these references disclose a compact housing capable of reducing flux leakage from the laminate stack assembly.

Japanese Patent No. 03-142804 discloses an E-shaped magnetic core including outer legs having a triangular cross-sectional shape and a center leg having a circular shape. However, the cross sectional shapes of the legs are designed to fit a fixed magnetic flux distribution thereby realizing more uniform distribution of magnetic flux. This reference does not appear to suggest mounting the E-shaped core in a housing to obviate flux leakage nor shaping the core to conform to the housing.

Thus, there is a need for a compact solenoid actuator assembly for operating a control valve in a fuel system including a stator assembly located in a housing to maximize dimensions of stator pole faces and to minimize flux leakage into the housing.

SUMMARY OF THE INVENTION

In view of the foregoing, a primary object of the present invention is to overcome the disadvantages associated with solenoid actuator assemblies disclosed in the related art. Specifically, the one object of the present invention is to provide a solenoid actuator assembly for a valve in a fuel system including a solenoid actuator assembly which is compact, inexpensive yet effectively minimizes the operational response time of the valve.

It is yet another object of the present invention to provide a solenoid actuator assembly for a fuel system including a stator assembly placed in a housing capable of increasing the effectiveness of the actuator thereby permitting optimal pressure capability, enhanced pressure response, and increased efficiency, flexibility and noise control.

Another object of the present invention is to provide a solenoid actuator system for a fuel system capable of reducing flux leakage into the housing while permitting positioning of a stator assembly within packaging constraints of the housing.

It is a further object of the present invention to provide a solenoid actuator assembly for a fuel system including a stator assembly placed in a housing capable of increasing the magnetic attractive force by increasing the cross sectional area of the stator assembly.

It is still a further object of the present invention to provide a solenoid actuator assembly for a fuel system including a stator assembly placed in a housing capable of minimizing the height and the diameter of the actuator module.

Yet another object of the present invention is to provide a solenoid actuator assembly for a fuel system including a stator assembly placed in a housing to improve the movement and response time of a control valve and ultimately an injector needle valve element.

Still another object of the present invention is to provide a solenoid actuator assembly for a fuel system having a minimal overall size to fit within the packaging constraints of a variety of engines and injectors.

A still further object of the present invention is to provide a fuel injector including a solenoid actuator assembly having a single housing for directly supporting a stator assembly and handling a compressive injector assembly load.

Yet another object of the present invention is to provide a solenoid actuator system for a fuel system including a stator assembly placed in a housing capable of minimizing load forces required to create fluid sealed joints.

These and other objects of the present invention are achieved by providing a solenoid actuator assembly for operating a valve comprising an actuator housing including a housing wall having an outer surface and an inner surface forming a housing cavity, a laminate stack assembly including a first pole piece having an outer face and a second pole piece having an outer face, wherein the laminate stack assembly is positioned within the housing cavity and the outer side faces are shaped and sized to extend along a geometrical extension of the outer surface of the housing wall to maximize a cross sectional area of the first and second pole pieces. Importantly, a flux dissipation reducing feature is formed in the housing wall adjacent each of the first and second pole pieces for reducing flux leakage from the first and second pole pieces into the actuator housing. The outer faces of the first and the second pole pieces are positioned in a non-overlapping relationship with, and free from enclosure by, the housing wall. The laminate stack assembly is preferably an E-type solenoid having outer legs and a center leg therebetween. The center leg may include a bore extending axially completely through the center leg for receiving an injection control valve pin. The valve pin is positioned for reciprocal movement in the bore relative to the center leg and extends completely through the bore. A valve pin guide is positioned in the bore and connected to the center leg for guiding the valve pin during reciprocal movement. The assembly may further include an armature positioned in the housing cavity adjacent the laminate stack assembly. The flux dissipation reducing feature includes a first slot and a second slot positioned on opposite sides of the actuator housing and extending outwardly completely through the housing wall. The first pole piece is positioned in the first slot and the second pole piece is positioned in the second slot. Each of the first and second slots may extend axially along the actuator housing from one end of the housing toward an opposite end a sufficient length so as to extend along at least half of the axial extent of the housing wall.

The armature may be positioned in the housing cavity adjacent the laminate stack assembly so that the laminate stack assembly and the armature are positioned completely within the axial extent of the actuator housing. A plastic overmold is preferably formed in the housing cavity and in the first and the second slots for securing the laminate stack assembly within the actuator housing. The plastic overmold is preferably positioned or formed radially between the armature and the inner surface of the actuator housing. The actuator housing may further include upper and lower end surfaces having a contact surface formed thereon for sealing abutment against a respective adjacent structure, for example, a fuel injector body component. The contact surface extends over only a portion of each of the lower and upper end surfaces. Preferably, the contact surface includes a first section positioned on one side of the actuator housing and a second section positioned separate from the first section on an opposite side of the actuator housing. A high pressure fuel circuit is provided for delivering fuel to the solenoid actuator assembly which includes at least one fuel passage formed in the actuator housing. Each pole piece of the solenoid stator or laminate stack assembly includes two side surfaces in addition to the outer face. The outer surface and the inner surface of the housing wall terminate prior to both a geometrical planar extension of each of the side surfaces of each of the first and second pole pieces thereby reducing flux leakage by forming the slots.

DETAILED DESCRIPTION OF THE PREFERRED EMBODIMENT

Figure 1:
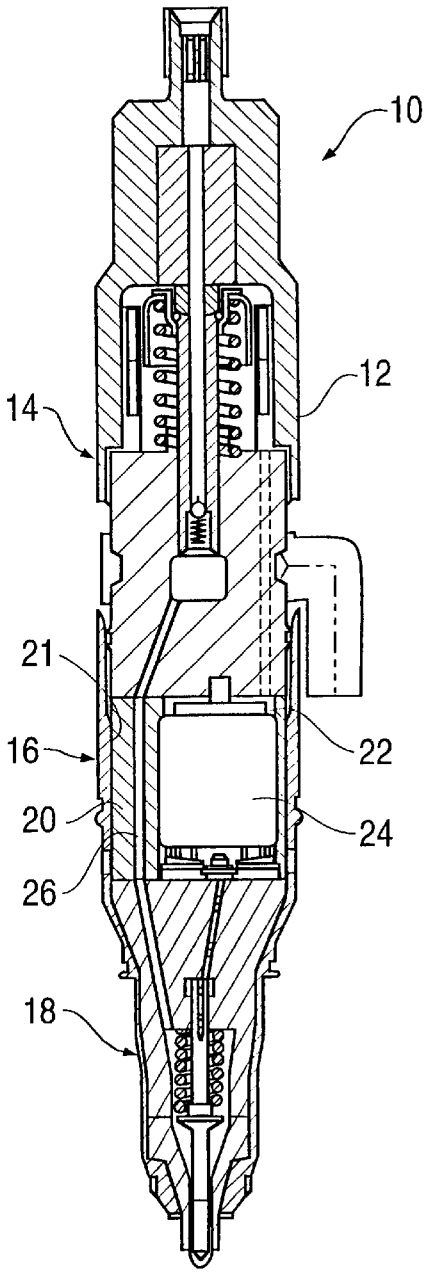
FIG. 1 (PRIOR ART)
FIG. 1 is a cross-sectional view of a prior art fuel injector body of a fuel injector system in an internal combustion engine having a pressure intensifier module, an actuator module and a nozzle module.
Figure 2:
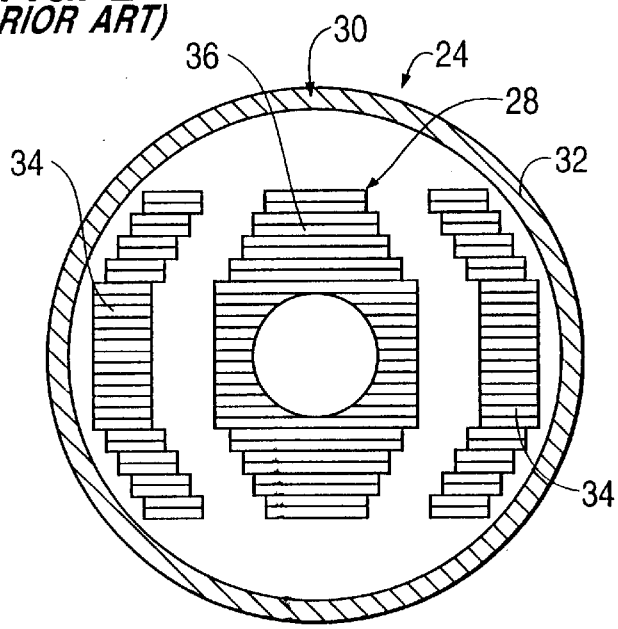
FIG. 2 (PRIOR ART)
FIG. 2 is a cross-sectional view of a prior art solenoid actuator assembly including an E-type laminate stack assembly.

Referring to FIG. 1, there is shown a conventional high pressure fuel injector, indicated generally at 10, for injecting metered quantities of fuel into a combustion chamber of an internal combustion engine in timed relation to the reciprocation of an engine piston (not shown). Fuel injector 10 includes an injector body 12 comprised of a pressure intensifier module 14, an actuator module 16 and a nozzle module 18. The structural and functional details of fuel injector 10 are disclosed in U.S. Pat. No. 5,676,114, the entire contents of which is hereby incorporated by reference. Fuel injector 10 is presently illustrated to clearly show the distinctions of the present invention over conventional assemblies. In particular, the conventional actuator module 16 includes a spacer housing 20 positioned adjacent an interior surface 21 of injector body 12 and in compressive abutting relationship between pressure intensifier module 14 and nozzle module 18. Spacer housing 20 includes cavity 22 for receiving a conventional solenoid actuator assembly 24 and one or more fuel passages 26 for providing high pressure fuel to nozzle module 18. As shown in FIG. 2, solenoid actuator assembly 24, which is used to control the movement of an injection control valve pin, may include a stator assembly 28 positioned in an actuator housing 30. Typically, actuator housing 30 is generally cylindrical in shape and includes a housing wall 32 defining a cavity for receiving stator assembly 28. Stator assembly 28 is preferably a laminate stack assembly formed from a plurality of plates laminated together. As shown in FIG. 2, stator assembly 28 includes outer legs 34 and a center leg 36 having outer faces which are sized and shaped to extend along the inner surface of housing wall 32. In this manner, the cross sectional area of outer legs 32 is increased thereby advantageously increasing the attractive force generated by the solenoid actuator assembly and thus decreasing response time.

Although the conventional solenoid actuator assembly shown in FIGS. 1 and 2 functions adequately under certain operating conditions, the conventional design limits the cross sectional area of the pole pieces or outer legs and permits magnetic flux dissipation into housing wall 32, thereby limiting the attractive force necessary to achieve the response time required for optimum control of fuel injection metering and timing.

Referring now to FIGS. 3–10, the solenoid actuator module or assembly of the present invention, indicated generally at 50, is designed to maximize the cross sectional area of pole pieces while minimizing magnetic flux dissipation into a housing wall thereby optimizing actuator response time and creating a compact assembly. Generally, solenoid actuator assembly 50 includes an actuator housing 52 having a housing wall 54 forming a housing cavity 56, and a solenoid stator assembly 58 positioned in housing cavity 56. Importantly, a flux dissipation reducing feature 60 (FIGS. 6, 9 and 10) is provided to minimize flux dissipation from solenoid stator assembly 58 into actuator housing 52. Also, as discussed more fully hereinbelow, solenoid actuator assembly 50 incorporates a single integrated housing containing the solenoid stator assembly 58 thereby providing additional space within the housing and permitting the cross sectional area of the pole pieces to be maximized for increasing the attractive force and improve response time. Solenoid actuator assembly 50 may be incorporated into any fuel injector requiring a compact solenoid actuator assembly and optimum valve response time, such as the injector of FIG. 1.

Figure 8:
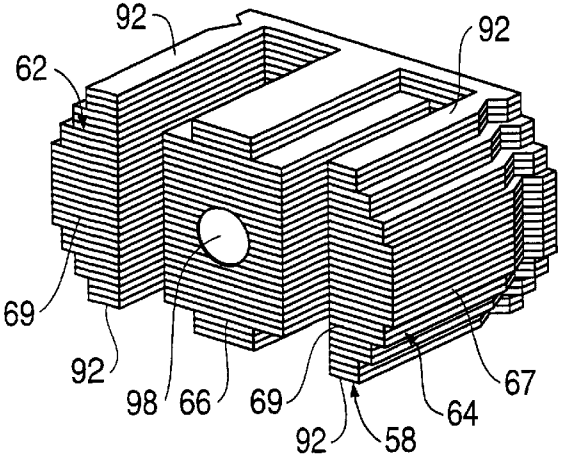
FIG. 8 is a perspective view of a E-type laminate stack assembly of the present invention.

As shown in FIG. 8, solenoid stator assembly 58 is preferably of the E-type formed from a laminated stack of plates for permitting faster magnetization and demagnetization. Solenoid stator or laminate stack assembly 58 includes a first pole piece or leg 62, a second pole piece or leg 64 and a center leg 66 positioned between first and second legs 62, 64. As shown in FIGS. 3–6, solenoid stator assembly 58 is positioned in housing cavity 56 of actuator housing 52. Actuator housing 52 includes an inner surface 68 forming housing cavity 56 and an outer surface 70 having a generally cylindrical shape. Actuator housing 52 further includes fuel passages 72 for delivering high pressure fuel through actuator housing 52 for delivery to the nozzle module. Actuator housing 52 may also include apertures 74 for receiving dowel pins for aligning actuator housing 52 with the adjacent components of the fuel injector, i.e. a pressure intensifier module and a nozzle module. Apertures 74 are formed in a lower end surface 76 of actuator housing 52 and in an upper end surface 78. Actuator housing 52 is also provided with access apertures 75 extending from upper end surface 78 through the housing for receiving electrical connectors 77 (FIG. 4) permitting an electrical connection to solenoid stator assembly 58. Lower end surface 76 includes a first contact surface area 80 positioned on one side of actuator housing 52 and a second contact surface 82 positioned on an opposite side of actuator housing 52. First contact surface 80 covers only a portion of the lower end surface 76 of actuator housing 52 so as to minimize the compressive force required to create a fluidic seal around the openings of fuel passages 72. Likewise, upper end surface 78 includes a first contact surface 84 surrounding the openings of fuel passages 72 and a second contact surface 86 formed on an opposite side of upper end face 78 from first contact surface 84. Again, the surface area of first and second contact surfaces 84 and 86 is reduced to only a portion of the total surface area of upper end surface 78 to minimize the required compressive assembly load placed on the injector components.

Figure 6:
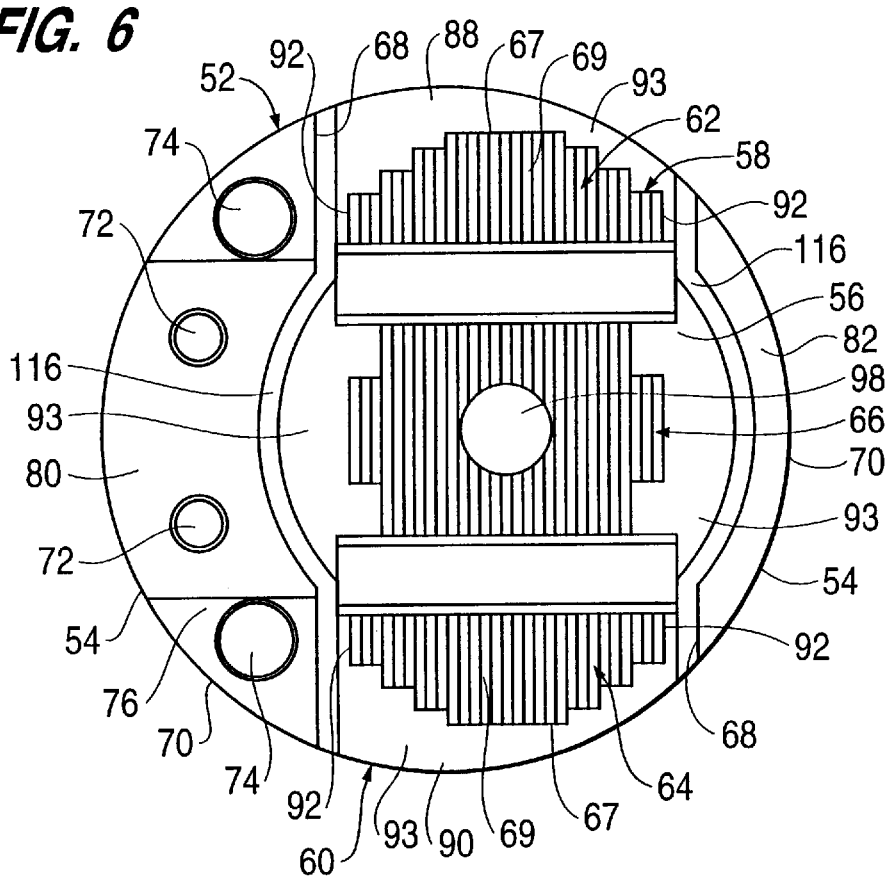
FIG. 6 is a bottom view of the actuator housing of FIG. 9 including a solenoid actuator positioned within the housing.
Figure 7:
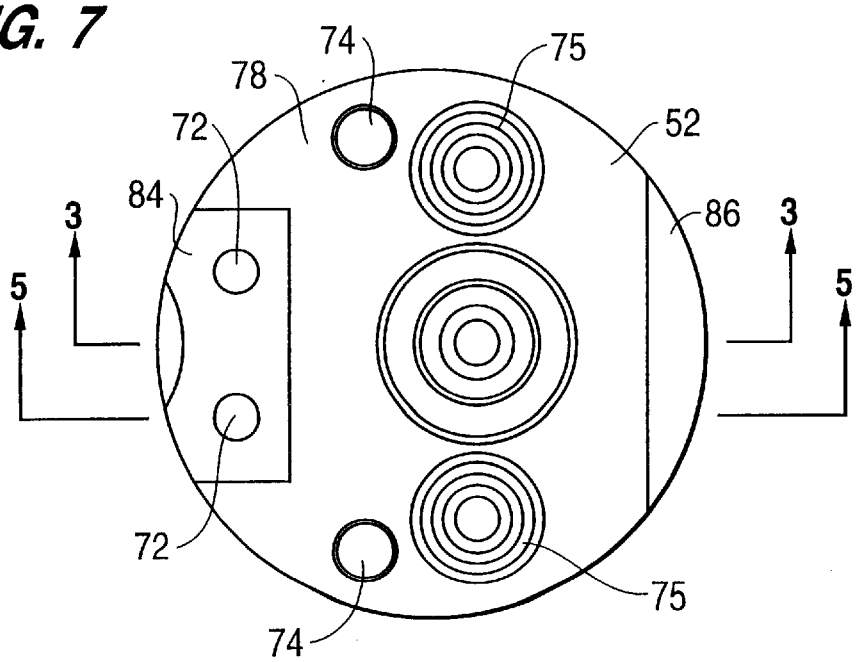
FIG. 7 is a top view of the actuator housing of FIG. 10 including a solenoid actuator positioned within the housing.
Figure 10:
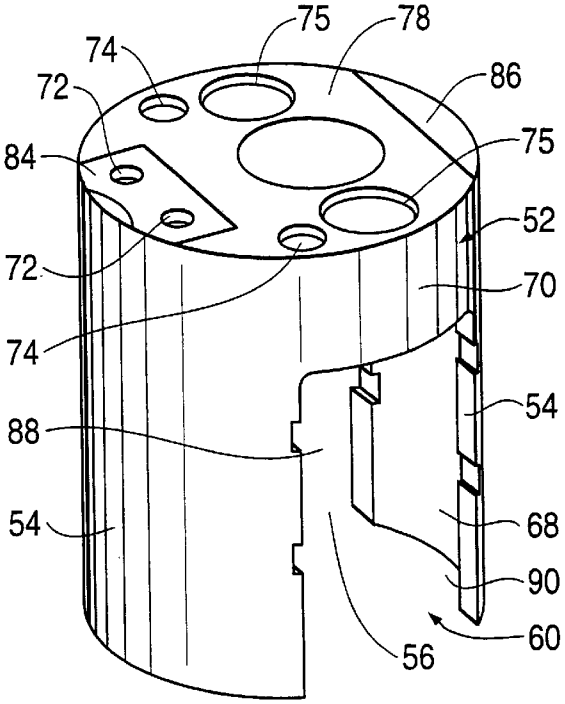
FIG. 10 is a top perspective view of the actuator housing of the present invention.
Figure 9:
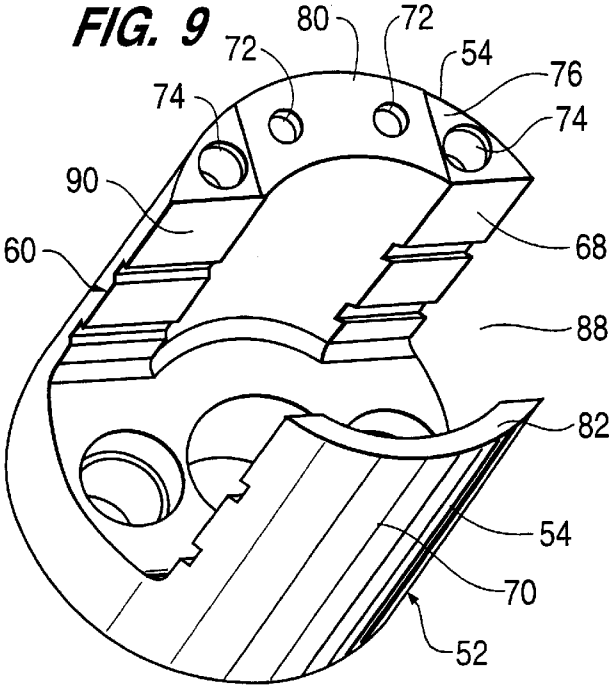
FIG. 9 is a bottom perspective view of an actuator housing of the present invention.

Referring to FIGS. 6, 9 and 10, flux dissipation reducing feature 60 includes a first slot 88 formed in one side of actuator housing 52 and a second slot 90 formed on an opposite side of actuator housing 52. First and second slots 88, 90 extend radially outwardly completely through housing wall 54. In addition, first and second slots 88, 90 extend from lower end surface 76 axially along actuator housing 52 terminating prior to upper end surface 78. Preferably, first and second slots 88, 90 extend along the axial extent of actuator housing 52 to form a predetermined slot length of at least half the axial extent of actuator housing 52 as shown in FIGS. 9 and 10. As clearly shown in FIG. 6, solenoid stator assembly 58 is positioned in housing cavity 56 with first pole piece or leg 62 positioned in first slot 88 and second pole piece or leg 64 positioned in second slot 90. Laminate stack assembly 58 also includes an outer face 67 formed on each pole piece 62, 64. Outer faces 67 are shaped and sized to maximize the cross sectional area of pole pieces 62, 64 to thereby increase the surface area of an end face 69 formed on the lower end of each pole piece. First and second pole pieces 62 and 64, and center leg 66, may be sized and shaped by either stacking nonuniformly sized laminates accordingly or by removing material from an oversized laminate stack assembly. As a result, the attractive force during each energization of the solenoid assembly is increased to decrease the response time of the assembly.

First and second slots 88, 90 function to remove the portions of housing wall 54 positioned radially outward from outer faces 67 of pole pieces 62 and 64. Consequently, flux leakage from pole pieces 62, 64 into actuator housing 52 is minimized since no housing wall exists adjacent outer faces 67 to receive flux leakage. Thus, pole pieces 62, 64 can be sized and outer faces 67 shaped to maximize the cross sectional area of end faces 69 by extending the pole piece outwardly toward a geometrical extension of the outer surface 70 of housing wall 54. Specifically, as a result of first and second slots 88 and 90, the inner surface 68 and outer surface 70 of housing wall 54 terminate circumferentially prior to pole pieces 62, 64. Pole pieces 62, 64 each include two side surfaces 92 positioned on opposite sides of the pole pieces and extending outwardly toward outer face 67 as shown in FIGS. 6 and 8. Outer surface 70 and inner surface 68 of housing wall 54 terminate prior to both the side surfaces of each pole piece on both sides of the pole pieces and also terminate prior to a geometrical planar extension of side surfaces 92 to thereby define slots 88 and 90. As a result, flux dissipation reducing feature 60, including first and second slots 88 and 90, functions to effectively prevent flux leakage into actuator housing 52.

Figure 3:
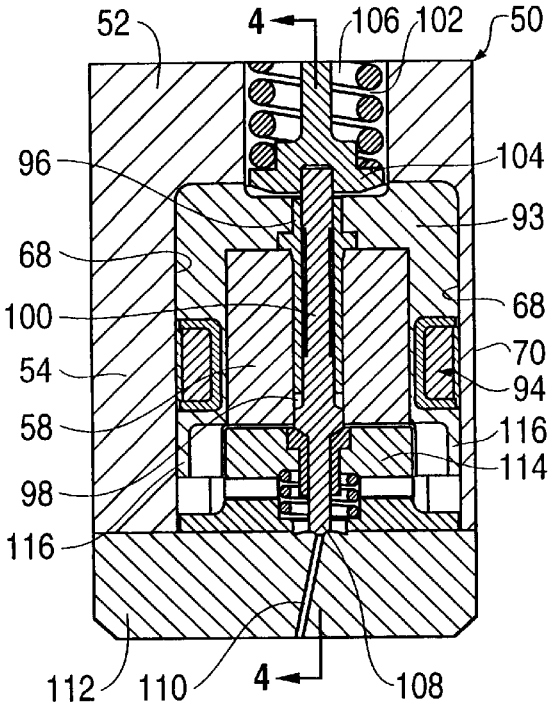
FIG. 3 is a cross-sectional view of the actuator module of FIG. 7 including a solenoid actuator positioned within the actuator module of the present invention taken along plane 3—3.
Figure 4:
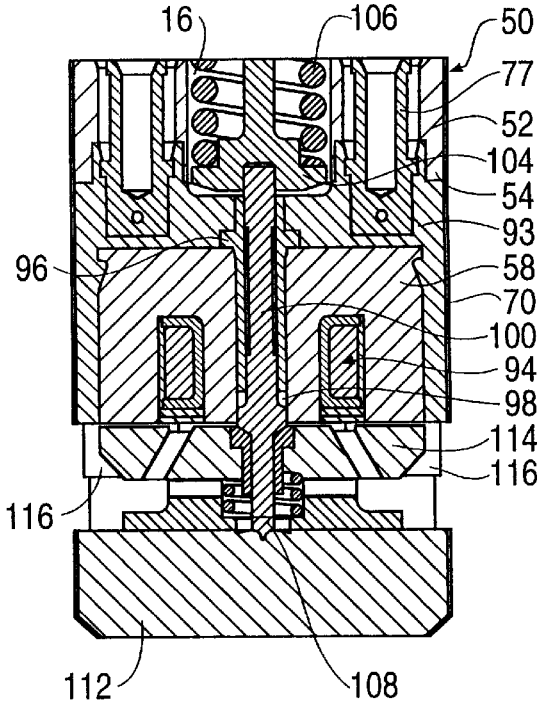
FIG. 4 is a cross-sectional view of the actuator module of FIG. 3 including a solenoid actuator positioned within the actuator module of the present invention taken along plane 4—4.

Referring to FIGS. 3–6, solenoid stator assembly 58 is positioned in housing cavity 56 and securely attached to actuator housing 52 by a nonmetallic overmold 93, i.e. a plastic material, injected into the space between solenoid stator assembly 58 and the inner surface 68 of housing wall 54. Solenoid actuator assembly 50 also includes a bobbin and coil assembly 94 positioned around center leg 66 of stator assembly 58. In addition, a valve pin guide 96 is positioned in a bore 98 (FIG. 8) extending completely through center leg 66. An injection control valve pin 100 is positioned in bore 98 and extends upwardly into a spring cavity 102 formed in the upper end surface 78. A spring seat 104 is mounted on the upper end of control valve pin 100 and positioned in spring cavity 102 for abutment by a return spring 106. The opposite end of injection control valve pin 100 extends downwardly and out of bore 98 to form a valve head 108 for controlling the flow of fuel through a control passage 110 formed in a spacer plate 112. Injection control valve pin 100 is biased by return spring 106 into a closed position blocking fuel flow through control passage 110. As presently disclosed, solenoid actuator assembly 50 operates a two-way injection control valve, including valve pin 100, which is alternately and selectively movable between an open position permitting fuel flow through a fuel passage and a closed position blocking fuel flow through the passage. However, solenoid actuator assembly 50 may be used to operate other types of valves such as a three-way, two-position injection control valve. Solenoid actuator assembly 50 also includes an armature 114 mounted on the lower end of injection control valve pin 100 and positioned adjacent end faces 69 of pole pieces 62, 64 as shown in FIG. 4.

Nonmetallic overmold 93 includes extensions 116 extending downwardly along inner surface 68 of housing wall 54 on both sides of actuator housing 52. As a result, extensions 116 are positioned radially between armature 114 and inner surface 68 of actuator housing 52. Extensions 116 are designed with a predetermined radial thickness necessary to ensure that the misaligning forces due to flux leakage from armature 114 to actuator housing 52 are minimized by limiting the minimum radial clearance between the armature and actuator housing. Without extensions 116, flux leakage from armature 114 into housing 52 generates misaligning forces which overcome the inherent aligning forces of the valve element causing rotation of the armature and loss of electromagnetic force relative to the aligned position of the armature and pole piece. Extensions 116 ensure that the aligning force remains greater than the misaligning forces caused by flux leakage thereby ensuring proper operation of solenoid actuator assembly 50 and injection control valve pin 100.

Figure 5:
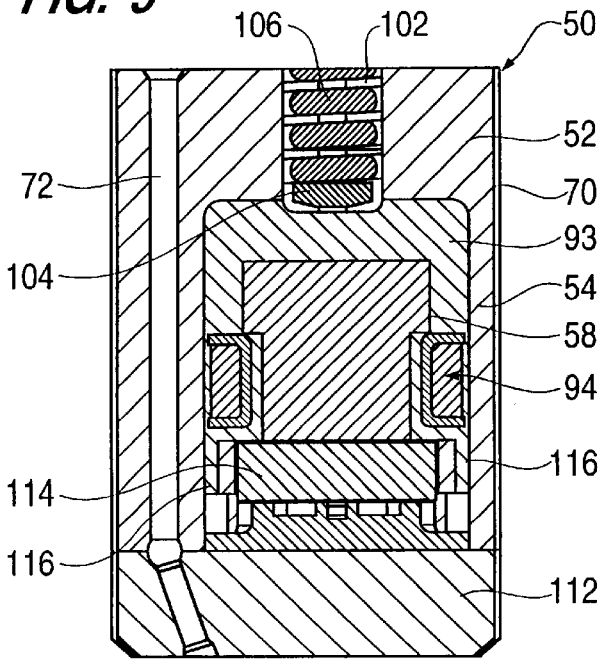
FIG. 5 is a cross-sectional view of the actuator module of FIG. 7 including a solenoid actuator positioned within the actuator module of the present invention taken along plane 5—5.

During assembly, solenoid stator assembly 58, including bobbin and coil assembly 94 and valve pin guide 96, are positioned in housing cavity 56 and nonmetallic overmold 93 injected into a space between solenoid actuator assembly 50 and the inner surface 68 of actuator housing 52. Of course, the appropriate end molds are placed in spring cavity 102 and around actuator housing 52 to contain the nonmetallic material in housing cavity 56. Once the material has solidified and the molds are removed, injection control valve pin 100, armature 114 and the remaining components can be inserted into their appropriate positions in actuator housing 52 as shown in FIGS. 3–5.

The present invention results in several advantages over conventional solenoid actuator assemblies. For example, the flux dissipation reducing feature 60 of the present invention, including slots 88 and 90, prevents flux leakage into the actuator housing thereby ensuring strong attractive forces resulting in a desirable decrease in the response time and thus greater control of fuel injection timing and metering. Also, solenoid actuator assembly 50 permits the pole pieces of the laminate stack assembly to occupy a maximum amount of space within actuator housing 52 thereby increasing the cross sectional area of the pole piece end faces 69 without increasing flux leakage into the housing thereby maximizing the attractive force generated by assembly 50. Importantly, solenoid actuator assembly 50 of the present invention avoids the use of the conventional dual housing design by integrally connecting laminate stack assembly 58 directly to the actuator housing 52 which also functions as an injector body component by transferring the compressive assembly load between injector components while integrally incorporating high pressure fuel passages. Conventional solenoid actuator assemblies, as shown in FIGS. 1 and 2, include a cylindrical actuator housing for supporting a stator assembly which is then positioned in a cavity formed in a second injector body spacer housing for handling compressive assembly loads and containing fuel passages. The solenoid actuator assembly 50 of the present invention creates a less expensive, more compact assembly while increasing the space available for the pole pieces by eliminating the inner actuator housing.

INDUSTRIAL APPLICABILITY

The solenoid actuator assembly of the present invention may be used in any fuel injection system of any internal combustion engine of any vehicle or industrial equipment in which accurate and reliable injection timing and metering are essential. The solenoid actuator assembly of the present invention is particularly useful in applications having strict packaging limitations and/or requiring fast valve response time, such as incorporation into the body of a fuel injector, and specifically in the lower portion of a needle controlled fuel injector.

We claim:

1. A solenoid actuator assembly for operating a valve comprising:

an actuator housing including a housing wall having an outer surface and an inner surface forming a housing cavity;

a laminate stack assembly including a first pole piece having an outer face and a second pole piece having an outer face, said laminate stack assembly positioned within said housing cavity, said outer faces of said first and second pole pieces being sized and shaped to extend along a geometrical extension of said outer surface of said housing wall to maximize a cross sectional area of said first and second pole pieces; and flux dissipation reducing means formed in said housing wall adjacent each of said first and second pole pieces for reducing flux leakage from said first and second pole pieces into said actuator housing.

2. The solenoid actuator assembly of claim 1, wherein said outer side faces of said first and second pole pieces are positioned in a non-overlapping relationship with, and free from enclosure by, said housing wall.

3. The solenoid actuator assembly of claim 1, wherein said laminate stack assembly is an E-type solenoid having outer legs and a center leg therebetween.

4. The solenoid actuator assembly of claim 3, wherein said center leg includes a bore extending axially completely through said center leg for receiving an injection control valve pin, said valve pin positioned for reciprocal movement in said bore relative to said center leg and extending completely through said bore.

5. The solenoid actuator assembly of claim 4, further including at least one pin guide positioned in said bore and connected to said center leg for guiding said valve pin during reciprocal movement.

6. The solenoid actuator assembly of claim 5, further including an armature positioned in said housing cavity adjacent to said laminate stack assembly.

7. The solenoid actuator assembly of claim 1, wherein said flux dissipation reducing means includes a first slot and a second slot, said first and second slots positioned on opposite sides of said actuator housing and extending outwardly completely through said housing wall; said first pole piece positioned in said first slot and said second pole piece positioned in said second slot.

8. The solenoid actuator assembly of claim 7, wherein each of said first and second slots extend axially along said actuator housing from one end of said housing wall toward an opposite end, said first and said second slots extending along at least half of an axial extent of said housing wall.

9. The solenoid actuator assembly of claim 7, further including an armature positioned in said housing cavity adjacent said laminate stack assembly, said actuator housing having an axial extent, said laminate assembly and said armature positioned completely within said axial extent of said actuator housing.

10. The solenoid actuator assembly of claim 1, further including a plastic overmold formed in said housing cavity and in said first and said second slots for securing said laminate stack assembly within said actuator housing.

11. The solenoid actuator assembly of claim 10, further including an armature positioned in said housing cavity adjacent said laminate stack assembly, said plastic overmold being positioned radially between said armature and said inner surface of said actuator housing.

12. The solenoid actuator assembly of claim 1, said actuator housing further including a lower end surface and an upper end surface, each of said lower end surface and said upper end surface including a contact surface for sealing abutment against a respective adjacent structure, said contact surface extending over only a portion of each of said lower end surface and said upper end surface, said contact surface including a first section positioned on one side of said actuator housing and a second section positioned separate from said first section on an opposite side of said actuator housing.

13. The solenoid actuator assembly of claim 1, further including a high pressure fuel circuit for delivering fuel to said solenoid actuator assembly, said high pressure fuel circuit including at least one fuel passage formed in said actuator housing.

14. An actuator module for a solenoid operated injection control valve assembly comprising:

an actuator module housing including a housing wall having an outer surface and an inner surface forming a housing cavity;

first and second slots formed in said actuator module housing on opposite sides of said actuator module housing, said first and second slots extending outwardly completely through said housing wall; and a stator assembly positioned within said housing cavity, said stator assembly including a first outer face positioned in said first slot on a first side of said housing cavity and a second outer face positioned in said second slot on a second side of said housing cavity, each of said first and said second outer faces shaped to extend along a geometrical extension of said outer surface of said housing wall for maximizing forces generated by the actuator module.

15. The actuator module of claim 14, further including an armature positioned within said housing cavity adjacent to said stator assembly and a nonmetallic overmold in said housing cavity for securing said stator assembly within said actuator module housing.

16. The actuator module of claim 14, further including a bore extending axially completely through a center portion of said stator assembly and an injection control valve pin positioned for reciprocal movement in said bore.

17. The actuator module of claim 14, further including an armature positioned within said housing cavity adjacent to said stator assembly.

18. The actuator module of claim 17, wherein said first and second slots extend axially along said actuator module housing from one end of said housing wall toward an opposite end to define a predetermined slot length, said stator assembly and said armature positioned within said predetermined slot length.

19. The actuator module of claim 18, further including a high pressure fuel circuit for delivering fuel to said solenoid actuator assembly, said high pressure fuel circuit including at least one fuel passage formed in said actuator module housing.

20. An actuator module for a solenoid operated injection control valve assembly comprising:

an actuator module housing including a housing wall having an outer surface and an inner surface forming a housing cavity; and a solenoid stator assembly including a first pole piece including an outer face and two side surfaces and a second pole piece including an outer face and two side surfaces, said solenoid stator assembly positioned within said housing cavity, said first and said second pole pieces being sized and shaped to extend along a geometrical extension of said outer surface of said housing wall to maximize forces generated by the actuator module;

wherein said outer surface and said inner surface of said housing wall terminate prior to both said two side surfaces and a geometrical planar extension of each of said two side surfaces of each of said first and said second pole pieces thereby reducing flux leakage.

21. The actuator module of claim 20, further including an armature positioned within said housing cavity adjacent to said solenoid stator assembly and a nonmetallic overmold in said housing cavity for securing said laminate stack assembly within said actuator module housing.

22. The actuator module of claim 21, wherein said nonmetallic overmold is positioned radially between said armature and said inner surface of said actuator housing.

23. A fuel injector comprising:

an injector body including an interior surface forming an injector cavity;

an actuator housing positioned within said injector cavity and including a housing wall having an exterior surface positioned adjacent said interior surface of said injector body and an inner surface forming a housing cavity, said actuator housing being secured to said injector body by a compressive load acting on said actuator housing;

a solenoid stator means for creating magnetic flux positioned in said housing cavity in contact with said inner surface of said actuator housing, said solenoid stator means including a laminate stack assembly and a nonmetallic overmold positioned between said laminate assembly and said inner surface of said actuator housing to secure said laminate stack assembly to said actuator housing; and a high pressure fuel circuit for delivering fuel through the fuel injector, said high pressure fuel circuit including at least one fuel passage formed in said actuator housing.

24. The fuel injector of claim 23, further including an armature positioned within said housing cavity adjacent to said solenoid stator means.

25. The fuel injector of claim 24, further including first and second slots formed in said actuator housing on opposite sides of said actuator housing, said first and second slots extending axially along said actuator housing from one end of said housing wall toward an opposite end, said first and said second slots extending along at least half of an axial extent of said housing wall.

26. The fuel injector of claim 25, further including a nonmetallic overmold in said housing cavity of said actuator housing for securing said solenoid stator means within said actuator housing.

27. The fuel injector of claim 26, wherein said nonmetallic overmold is positioned radially between said armature and said inner surface of said actuator housing.

* * * * *